United States Patent [19]

Suzuki

[11] Patent Number: 4,754,679

[45] Date of Patent: Jul. 5, 1988

[54] TONE SIGNAL GENERATION DEVICE FOR AN ELECTRONIC MUSICAL INSTRUMENT

[75] Inventor: Hideo Suzuki, Hamamatsu, Japan

[73] Assignee: Nippon Gakki Seizo Kabushiki Kaisha, Hamamatsu, Japan

[21] Appl. No.: 13,183

[22] Filed: Feb. 9, 1987

Related U.S. Application Data

[63] Continuation of Ser. No. 705,553, Feb. 26, 1985, abandoned.

[30] Foreign Application Priority Data

Feb. 29, 1984 [JP] Japan ..... 59-36134

[51] Int. Cl.[4] ..... G10H 1/02

[52] U.S. Cl. ..... 84/1.19; 84/1.26

[58] Field of Search ..... 84/1.19, 1.26

[56] References Cited

U.S. PATENT DOCUMENTS 4,138,915 2/1979 Nagai et al. ..... 84/1.19
4,227,435 10/1980 Ando et al. ..... 84/1.19
4,383,462 5/1983 Nagai et al. ..... 84/1.26

FOREIGN PATENT DOCUMENTS 142396 8/1983 Japan .

*Primary Examiner*—Russell E. Adams
*Attorney, Agent, or Firm*—Spensley Horn Jubas & Lubitz

[57] ABSTRACT

A basic tone signal generator and a difference signal generator are provided. A desired tone signal is obtained by synthesizing a basic tone signal and a difference signal generated from these generators respectively. The basic tone signal has principal characteristics of a desired tone signal whose tone color (waveshape) changes subtly with time as in a tone of an acoustic musical instrument, but it is not the desired tone signal itself, including some errors, i.e., difference from the desired tone signal. The difference signal represents the difference between the desired tone signal and the basic tone signal. Since the basic tone signal is constituted by basic tone data whose data amount can be substantially reduced as compared to an amount of data required for reproducing the desired tone signal itself with a high resolution and the difference signal is constituted by difference data whose data amount can be very small. Therefore, a tone synthesization by combining the basic tone signal and the difference signal contributes greatly to the simplification of the circuit construction of an electronic musical instrument.

13 Claims, 5 Drawing Sheets

TONE SIGNAL GENERATION DEVICE FOR AN ELECTRONIC MUSICAL INSTRUMENT

This is a continuation of copending application Ser. No. 705,553 filed on Feb. 26, 1985, now abandoned.

BACKGROUND OF THE INVENTION

This invention relates to a tone signal generation device employed in an electronic musical instrument and like devices and, more particularly, to a device capable of generating with a relatively simple construction a tone of a high quality whose tone color changes subtly as time elapses just as in a tone of an acoustic musical instrument.

Known in the art are (1) a device storing a full waveshape from the rising of sounding of a tone to the termination thereof in a waveshape memory and reading out this full waveshape all through and (2) a device storing a tone waveshape for plural periods in a waveshape memory and repeatedly reading out all or part of the stored waveshape. These devices are specifically disclosed in U.S. Pat. No. 4,383,462 or Japanese Preliminary Patent Publication No. 142396/1983. The above U.S. Pat. No. 4,383,462 discloses an electronic musical instrument which aims at producing a tone of a high quality by prestoring a full waveshape from rising to termination of sounding of the tone in a memory and reading out the waveshape therefrom. In the waveshape memory WM31 in FIG. 3 of this U.S. patent, a full waveshape is stored and this full waveshape is read out in response to a signal KD which represents a key depression timing. Such system in which the full waveshape is stored requires a large memory capacity. In order to improve this point, it has been conceived to store a part of waveshape of plural periods out of the complete sounding period in a waveshape memory and obtain a tone signal by repeatedly reading out the partial waveshape. In the above U.S. Pat. No. 4,383,462, an example of such improvement is shown in FIG. 6. A complete waveshape in the attack period is stored in the waveshape memory WM61 and at least one fundamental period of a tone waveshape is stored in the waveshape memory WM62. An attack waveshape is read out from the memory WM61 in response to the key depression (KD signal) and the tone waveshape of the fundamental period is repeatedly read out from the memory WM62 after completion of the readout of the attack waveshape (IMF signal) until the termination of tone generation (DF signal).

The above described prior art tone signal generation devices are disadvantageous in that they require a waveshape memory of a large capacity, particularly so if a tone waveshape signal of a satisfactorily high quality is to be obtained with a high resolution.

It is, therefore, an object of the invention to provide a tone signal generation device capable of generating a tone signal whose tone color (i.e., waveshape) changes with time with a relatively simple construction.

SUMMARY OF THE INVENTION

According to the invention, basic tone signal generation means and difference signal generation means are provided and a desired tone signal is obtained by synthesizing a basic tone signal and a difference signal generated by these means. The basic signal generation means generates a basic tone signal whose waveshape changes with time in accordance with a tone pitch designated by tone pitch designation means. The difference signal generation means comprises a difference memory storing data of the difference signal corresponding to difference between a desired tone signal and the basic tone signal, accesses the difference memory in accordance with the tone pitch designated by the tone pitch designation means and generates the difference signal in response thereto. As a desired tone signal, a tone signal whose tone color (waveshape) changes subtly with time as in a tone of an acoustic musical instrument, is employed. The basic tone signal has principal characteristics of the desired tone signal but it is not the desired tone signal itself, including some errors, i.e., difference from the desired tone signal. Therefore, the basic tone signal can be generated with an amount of data which is substantially reduced as compared to an amount of data required for reproducing the desired tone signal itself with a high resolution whereby the construction of the basic tone signal generation means can be composed with a relatively simplified circuit construction. Since the difference signal corresponds to difference between the desired tone signal and the basic tone signal, this difference signal consists of a small amount of data and the difference signal generation means therefore can be made of a relatively simple circuit construction. That is, the difference memory can be made of a memory of a small capacity. Thus, according to the invention, the constructions of the basic tone signal generation means and the difference signal generation means can be simplified. Moreover, according to the invention, since a tone signal corresponding to the desired tone signal can be produced by synthesizing the basic tone signal and the difference signal, a tone signal of a high quality whose tone color (waveshape) changes subtly with time, as in a tone of a natural musical instrument, can be generated with a relatively simple construction.

A tone signal generation system to be employed in the basic tone signal generation means can be selectively adopted from among various systems. For example, a tone waveshape data memory storing data of a tone waveshape of plural periods may be employed and this memory may be accessed in accordance with the designated tone pitch. In this case, the tone waveshape data may be stored in the memory not only by the PCM (pulse code modulation) system but by any other suitable system such as the delta modulation system.

Alternatively, the basic signal generation means may be composed by utilizing a parameter synthesis system according to which the tone color (waveshape) of a tone signal to be generated is determined in accordance with a parameter. In this case, the waveshape of the basic tone signal can be changed with time by changing the parameter with time. There are LPC (linear prediction coding) and PARCOR (partial auto-correlation) systems for the parameter synthesis system in the voice synthesis technique and these systems can be applied to the basic tone signal generation means. More specifically, a digital filter is used and a filter parameter thereof is suitably established and this filter parameter is changed with time.

Alternatively, a plurality of waveshape segments are intermittently sampled along a time axis from a desired tone signal whose waveshape changes with time, these waveshape segments are stored in a memory and one of these segments is repeatedly read out, with the waveshape segment to be read out being successively switched one by one to generate a basic tone signal changing with time.

In case a difference signal is quantized (coded) and the quantized data is stored in a memory, a quantizing error occurs. For this reason, a tone signal which is finally obtained by synthesizing the basic tone signal and the difference signal is not completely identical to the desired tone signal. Elimination of such quantizing (coding) error in the difference signal can be achieved by providing not only a first difference signal generation means but second, third or more difference signal generation means as required and synthesizing all of the difference signals with the basic tone signal. The first difference signal generated by the first difference signal generation means is a basic signal of a difference signal (first real difference waveshape) corresponding to difference between the desired tone signal and the basic signal. The second difference signal generated by the second difference signal generation means is a basic signal corresponding to a difference signal (second real difference waveshape) between the first real difference waveshape and the first difference signal. Likewise, an n-th difference signal generated by an n-th difference signal generation means is a basic signal of a difference signal corresponding to difference between an (n−1)th real difference waveshape and an (n−1)th difference signal.

Preferred embodiments of the invention will now be described with reference to the accompanying drawings.

BRIEF DESCRIPTION OF THE DRAWINGS

In the accompanying drawings.

DESCRIPTION OF PREFERRED EMBODIMENTS

Figures 1A, 1B:
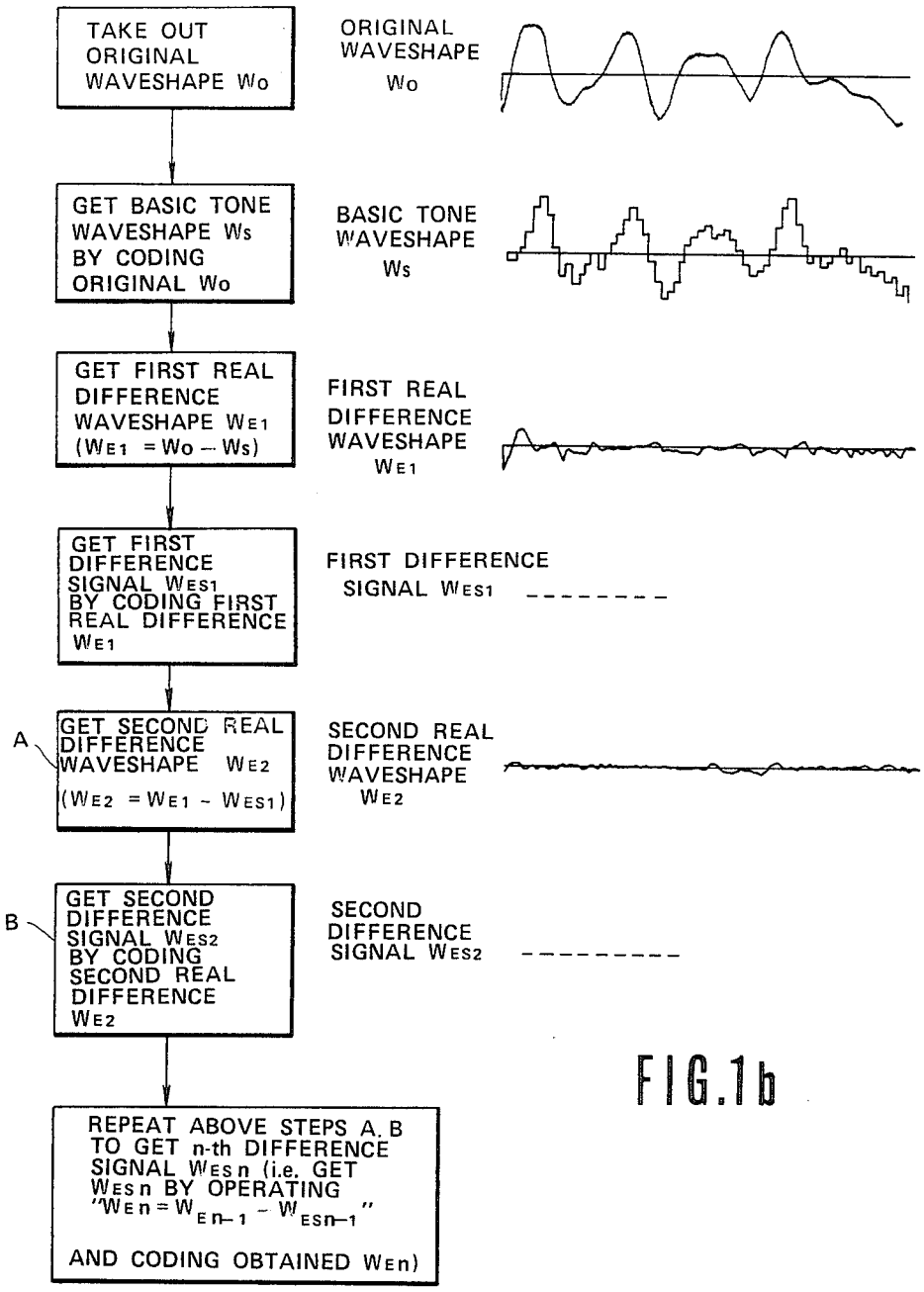
FIG. 1*a* is a flow chart showing an example of a procedure for taking out a basic tone signal and a difference signal from a desired tone signal (original waveshape) as a procedure prior to carrying out the present invention.
FIG. 1*b* is a waveshape diagram showing examples of waveshapes appearing in respective stages of this procedure.

As a prior step for carrying out the invention, a procedure is required for taking out a basic tone signal and a difference signal from a desired tone signal (original signal). Referring to FIGS. 1*a* and 1*b*, the flow chart of FIG. 1*a* shows steps of the procedure and FIG. 1*b* shows examples of signal waveshapes appearing in the respective steps of the procedure in which a waveshape of a coded difference signal is omitted for convenience's sake.

First, a desired original waveshape is taken out (e.g., from a tone of an acoustic musical instrument). Then the original waveshape is coded (sampled and quantized) to produce a basic tone waveshape. This basic tone waveshape corresponds to a basic tone signal. Data corresponding to this basic tone waveshape, for example, is stored in a memory. The original tone waveshape is a waveshape of a complete sounding period from the beginning of sounding to the end thereof. So is the basic tone waveshape so that the waveshape thereof changes with time. According to the invention, coding of this original waveshape (i.e., production of a coded basic tone waveshape) may be performed rather coarsely and, accordingly, substantial reduction of data is possible. In the case of the parameter synthesis system, a parameter for reproducing the original waveshape is determined. If the tone synthesis is performed according to the parameter thus determined, a basic tone signal as exhibited by the basic tone waveshape is obtained. That is, the original waveshape is not synthesized due to an error in the parameter synthesis but the basic tone signal as exhibited by the basic tone waveshape can only be obtained.

Then difference between the original waveshape (designated as $W_O$) and the basic tone waveshape (designated by $W_S$) is obtained to produce a first real difference waveshape (designated by $W_{E1}$).

The first real difference waveshape $W_{E1}$ is coded (sampled and quantized) to produce a first difference signal (designated by $W_{ES1}$).

The coded first difference signal $W_{ES1}$ is not completely identical to the first real difference waveshape $W_{E1}$, so that it contains an error. Such error can be eliminated by further obtaining an error between the real difference waveshape $W_{E1}$ and the difference signal $W_{ES1}$, i.e., a second real difference waveshape $W_{E2}=W_{E1}-W_{ES1}$ and coding this second real difference waveshape to produce a second difference signal $W_{ES2}$. Then, a step of producing difference between such real difference waveshape and a coded difference signal (step A) and a step of coding this difference (step B) are repeated as many times as required. Describing in general terms, an n-th real difference waveshape $W_{EN}$ is obtained by difference between an (n−1)th real difference waveshape $W_{En-1}$ and an (n−1)th coded difference signal $W_{ESn-1}$ and an n-th coded difference signal $W_{ESn}$ is obtained by coding this signal $W_{En}$.

As will be understood from the above, the larger is the order number n of the coded difference signal, the higher is the fidelity of a tone signal (i.e., resembling more closely to the original waveshape) when these n difference signals have finally been added together and synthesized with the basic tone waveshape $W_S$. Further, the amount of data of each individual coded difference signal can be reduced.

Figure 2:
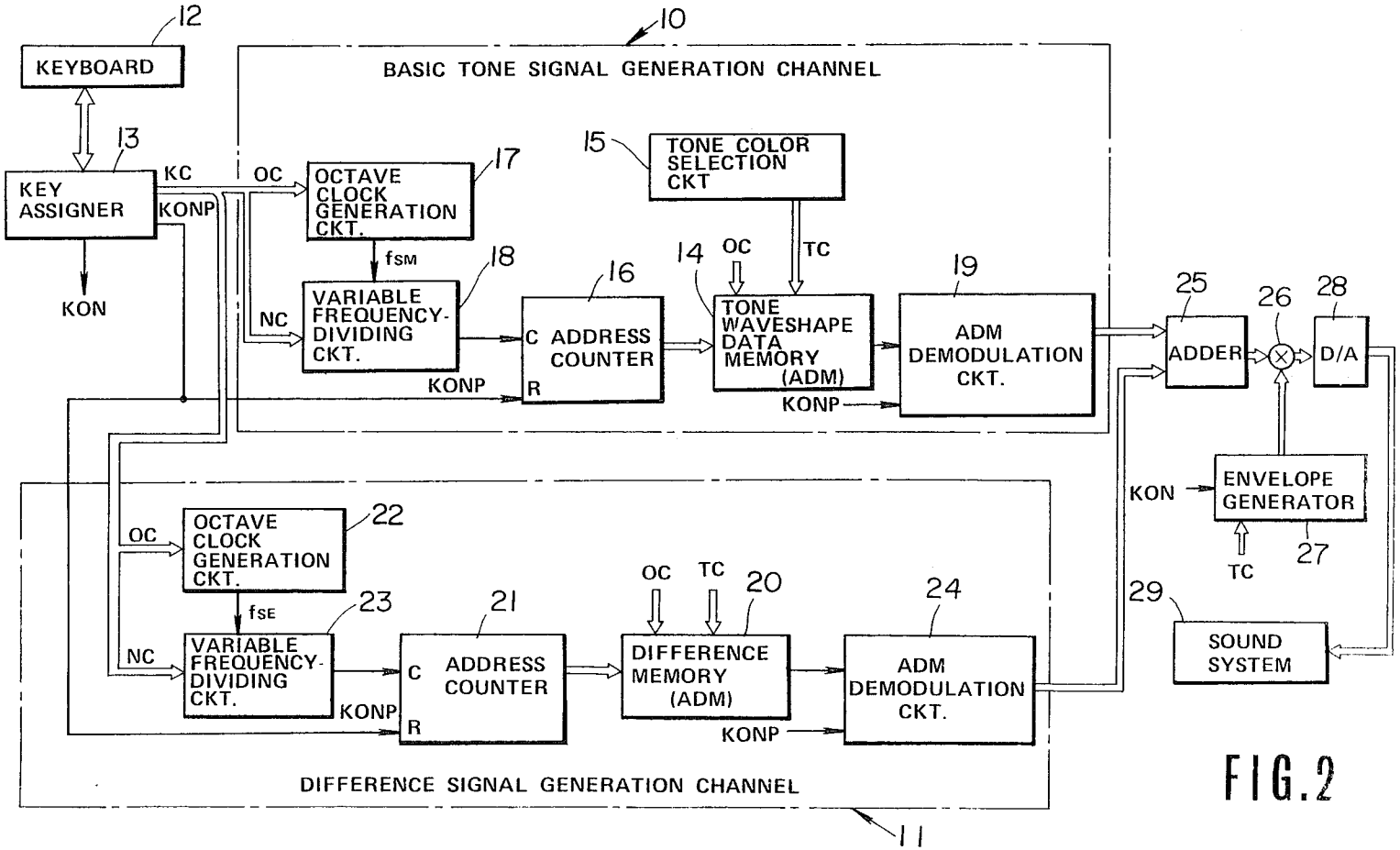
FIG. 2 is an electrical block diagram showing an embodiment of the invention.

The embodiment of the invention shown in FIG. 2 comprises a basic tone signal generation channel 10 and a single channel of a difference signal generation channel 11. A keyboard 12 has a plurality of keys designating the tone pitch of a tone to be generated. A key assigner 13 detects depression and release of a key on the keyboard 12 and assigns sounding of a tone corresponding to a depressed key (i.e., designated tone pitch) to an available one of a plurality of tone generation channels. A key code KC representing a key having been assigned to each channel and a key-on signal KON representing the on-off state of this key are delivered from the key assigner 13 on a time-division multiplexed basis. A key-on pulse KONP generated at the beginning of depression of the key also is delivered from the key assigner 13 in accordance with the time division timing of the channel to which the key has been assigned.

The basic tone generation channel 10 generates a basic tone signal whose waveshape changes with time in accordance with a tone pitch designated by the depression of the key. The channel 10 comprises a tone waveshape data memory 14 storing data of a tone waveshape of plural periods. The data of the tone waveshape to be stored in the tone waveshape data memory 14 is the data of the above described coded tone waveshape ($W_S$ of FIG. 1). For example, data of the basic tone waveshape for N tone colors with respect to 6 octaves of the first through sixth octaves totalling 6·N is stored in the memory 14. In the present embodiment, the basic tone waveshape changes when the octave changes. An octave code OC of the key code KC provided by the key assigner 13 is applied to the memory 14 and a tone color selection information TC also is applied to the memory 14. One of the 6·N coded tone waveshapes is designated by the combination of the octave code OC and the tone color selection information TC and data of the designated basic tone waveshape is successively read out in response to an address signal provided by an address counter 16.

The octave code OC of the key code KC provided by the key assigner 13 is applied to an octave clock generation circuit 17 and a note code of the key code KC is applied to a frequency dividing ratio control input of a variable frequency-dividing circuit 18. The octave clock generation circuit 17 generates an octave clock pulse $f_{SM}$ having a frequency corresponding to the applied octave code OC. This octave clock pulse $f_{SM}$ is applied to the variable frequency-dividing circuit 18 where it is frequency-divided at a frequency dividing ratio corresponding to the note code NC. Thus, the frequency dividing circuit 18 produces a clock pulse having a frequency corresponding to the tone pitch designated by the key code KC and this clock pulse is applied to a count input C of the address counter 16.

The address counter 16, the octave clock generation circuit 17 and the variable frequency-dividing circuit 18 are constructed such that they can operate on a time shared basis with respect to each channel. The key-on pulse KONP is applied to a reset input terminal R of the address counter 16 so that contents of counting corresponding to a channel to which a newly depressed key has been assigned are reset and counting is started from an initial address. The address signal provided by the address counter 16 changes at a clock rate corresponding to the designated tone pitch whereby data of the basic tone waveshape is read out from the memory 14 at a frequency corresponding to the designated tone pitch.

In this embodiment, data of the basic tone waveshape is stored in the tone waveshape data memory 14 by an adaptive delta modulation (ADM) system. For this purpose, an ADM demodulation circuit 19 is provided on the output side of the memory 14. The circuit 19 demodulates the basic tone waveshape data of the ADM system read out from the memory 14 to provide a basic tone signal having a normal sample point amplitude.

The difference signal generation channel 11 comprises a difference memory 20 storing data of a difference signal (data of the coded first difference signal $W_{ES1}$) corresponding to difference between the desired tone signal (the original waveshape $W_O$) and the basic tone signal obtained in the basic tone signal generation channel 10 (the basic tone waveshape $W_S$). This memory 20 is accessed in accordance with the tone pitch designated by the key code KC to generate a difference signal (the first difference signal $W_{ES1}$). The difference memory 20 stores, as the above described tone waveshape data memory 14, data for coded difference signals ($W_{ES1}$) of N tone colors with respect to 6 octaves, totalling 6·N data. One of the difference signals ($W_{ES1}$) is designated by the octave code OC and the tone color selection information TC and this difference signal data is successively read out in response to the address signal provided by the address counter 21.

As in the channel 10, an octave clock generation circuit 22 and a variable frequency-dividing circuit 23 are provided for preparing a clock frequency corresponding to the designated tone pitch. An octave clock pulse $f_{SE}$ corresponding to the octave code OC is frequency-divided in accordance with the note code NC and the frequency-divided output is applied to a count input terminal C of the address counter 21. The address counter 21 receives at its reset input terminal R the key-on pulse KONP.

The data storing system in the difference memory 20 is the ADM system as in the memory 14. For this purpose, an ADM demodulation circuit 24 is provided on the output side of the memory 20. The circuit 24 demodulates the difference signal data of the ADM system to produce a difference signal having a demodulated sample point amplitude.

The basic tone signal ($W_S$) generated in the channel 10 and the difference signal ($W_{ES1}$) generated in the channel 11 are added and synthesized together in an adder 25 to produce a tone signal ($W_O' = W_S + W_{ES1}$) corresponding to the desired tone signal ($W_O$). This tone signal is applied to a multiplier 26 where it is multiplied with an envelope shape signal from an envelope generator 27 and thereafter is converted to an analog signal by a digital-to-analog converter 28 and supplied to a sound system 29. If data having been imparted with an amplitude envelope is stored in the tone waveshape data memory 14, a tone signal having been imparted with the amplitude envelope is obtained from the adder 25. In this case, however, the envelope generator 27 is required for performing damping and sustain controls determined by the tone color selection information TC and the key-on signal KON after key-off. On the other hand, if the data stored in the memories 14 and 20 are determined so that the amplitude envelope level of the tone signal provided by the adder 25 is controlled at a specific value, the envelope generator 27 is required for imparting the amplitude envelope.

Figure 3:
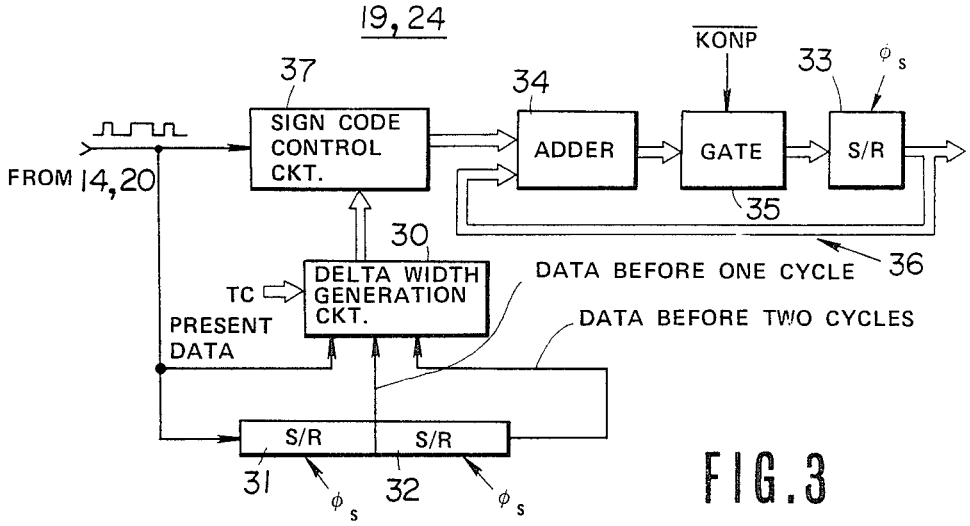
FIG. 3 is an electrical block diagram showing an example of an ADM demodulation circuit shown in FIG. 2.

FIG. 3 shows an example of the ADM demodulation circuits 19 and 24 which performs demodulation on the basis of present ADM data, ADM data one cycle before and ADM data two cycles before. The ADM data read out from the memories 14 and 20 is applied to a delta width generation circuit 30 and also to a one-bit shift register 31 having stages of a number equivalent to the number of the channels. The output of the last stage of the shift register 31 is applied to a second one-bit shift register 32 having stages of a number equivalent to the number of the channels. The shift registers 31 and 32 are shift-controlled in response to a clock pulse $\phi_s$ synchronized with a channel time division time slot and outputs of the last stages of the respective shift registers are applied to the delta width generation circuit 30 as the ADM data one cycle before and the ADM data two cycles before respectively.

The delta width generation circuit 30 generates data representing a delta width of a specific value in accordance with the combination of the three ADM data of present, one cycle before and two cycles before with respect to the same channel. The value of the delta width is also controlled by the tone color selection information TC. The generated delta width data is applied to a sign code control circuit 37 where it is provided with a positive or negative sign code in accordance with "1" or "0" of the present ADM data (read out outputs of the memories 14 and 20). The delta width data thus provided with the positive or negative sign is applied to an accumulator 36 including a shift-register 33 of plural bits having stages of a number equivalent to the number of the channels and an adder 34 and a gate 35. In the accumulator 36, the delta width data of the same channel is accumulated and stored in the shift register 33. The gate 35 is enabled by a signal $\overline{\text{KONP}}$ which is an inverted signal of the key-on pulse KONP to clear, at the beginning of depression of the key, contents stored in the shift register 33 corresponding to the channel to which the key has been assigned.

If a common sampling rate is used in coding the basic tone waveshape and the difference signal, the frequencies of the octave clock pulses $f_{SM}$, $f_{SE}$ become common through the two channels 10 and 11 so that the octave clock generation circuit 17 and 22, the variable frequency-dividing circuits 18 and 23 and the address counters 16 and 21 can be realized by using single octave clock generation circuit, variable frequency-dividing circuit and address counter on a time division basis between the two channels 10 and 11. If different sampling rates are used in coding the basic tone signal and the difference signal, the frequencies $f_{SM}$ and $f_{SE}$ will become different.

Figure 4:
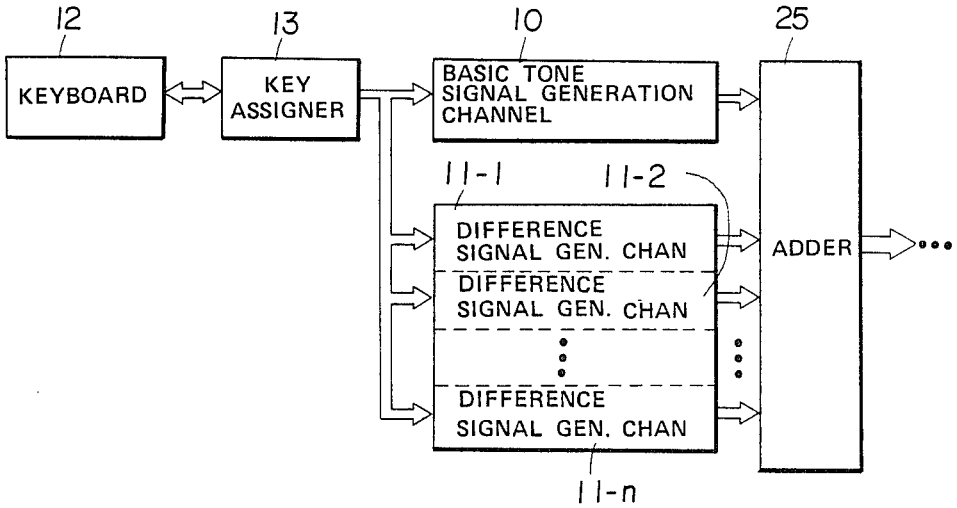
FIG. 4 is an electrical block diagram showing another embodiment of the invention.

FIG. 4 shows an embodiment in which a plurality of difference signal generation channels 11-1 through 11-n are provided. Each individual one of the channels 11-1 through 11-n is of the same constuction as the difference signal generation channel 11. However, difference signal data to be stored in difference memories 20 of the channels 11-1 through 11-n is different from one another, i.e., each memory 20 storing data of one of the above described coded first through n-th difference signals ($W_{ES1}$–$W_{ESn}$). The adder 25 adds and synthesizes the basic tone signal ($W_S$) generated in the basic tone signal generation channel 10 and the coded first through n-th difference signals ($W_{ES1}$–$W_{ESn}$) generated in the respective channels 11-1 through 11-n.

The data storing system in the tone waveshape data memory 14 and the difference memory 20 is not limited to the above described ADM system but any suitable system such, for example, as PCM (pulse code modulation), difference PCM (DPCM), delta modulation (DM), adaptive PCM (APCM) and adaptive difference PCM(ADPCM) may be employed.

The reading method of the memories 14 and 20 are not limited to the combination of the variable frequency-dividing circuit and the address counter as shown in FIG. 2 but any suitable system such as one accumulating the frequency number may be employed.

The memories 14 and 20 have been described as storing data of the basic tone signal and data of the difference signal over the complete sounding period from the beginning of sounding to the end thereof. Modifications such as storing data for a waveshape of plural periods in a part of the sounding period and reading it out repeatedly, or reading out a specific waveshape of plural periods once and other waveshape of plural periods repeatedly may be made utilizing a known technique. In this case, the difference memory 20 may be adapted to store data of the difference signal over the complete sounding period.

Figure 5:
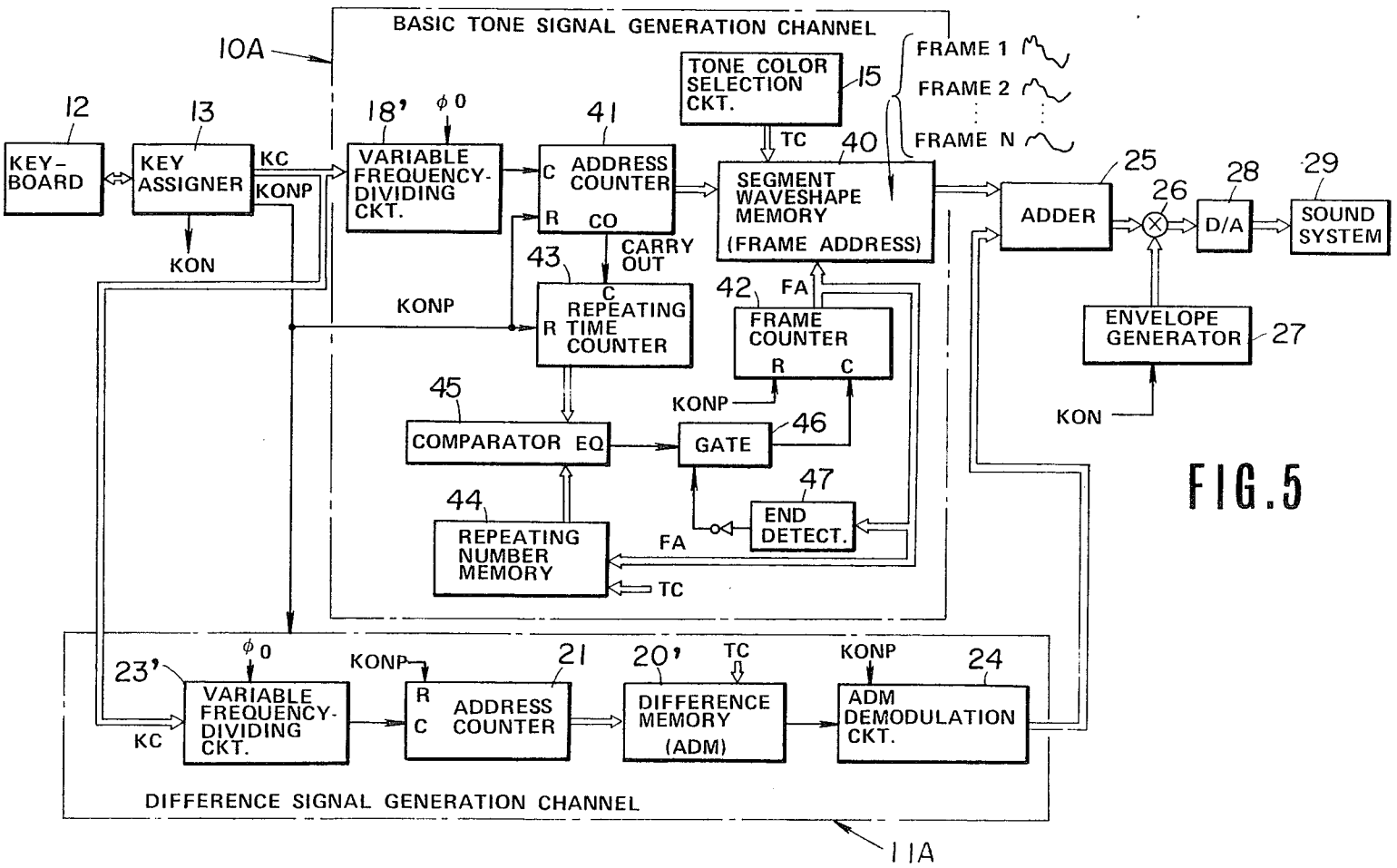
FIG. 5 is an electrical block diagram showing still another embodiment of the invention.

FIG. 5 shows another embodiment of the invention. In this embodiment, the construction of the basic tone signal generation channel 10A is different from the corresponding one of the embodiment of FIG. 2. In FIG. 5, the same reference characters as in FIG. 2 designate the same circuits and detailed description thereof will be omitted.

The basic tone signal generation channel 10A comprises a segment waveshape memory 40 which stores a plurality of different segment waveshapes. One segment waveshape is repeatedly read out from this memory 40 a suitably selected number of times (or during a specific period of time) and the segment waveshape to be read out is successively switched one by one whereby a basic tone signal whose waveshape changes with time is generated.

Figure 6A:
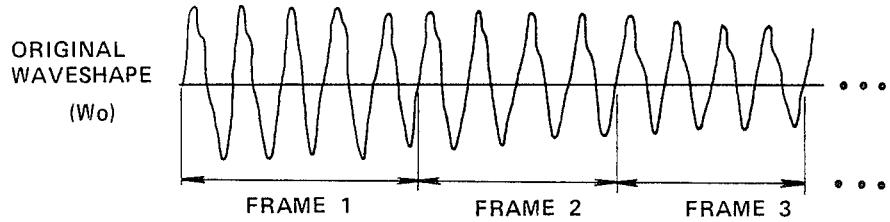
FIGS. 6*a*, 6*b* and 6*c* are waveshape diagrams showing examples of a desired tone signal, a basic tone signal and a difference signal taken out in the procedure prior to carrying out, of the invention shown in FIG. 5.
Figure 6B:
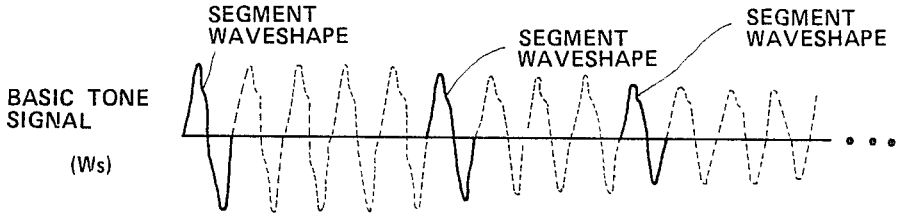

Description will first be made about a prior step concerning preparation of a segment waveshape to be stored in the segment waveshape memory 40 and difference signal data to be stored in a difference memory 20'. A desired tone signal (original waveshape $W_O$) is taken out of a tone of e.g., an acoustic musical instrument. The complete sounding period of this tone is divided into plural frames and one period of waveshape is taken out of each of these frames. FIG. 6*a* shows a state in which the original waveshape $W_O$ has been divided into respective frames and FIG. 6*b* shows, in a solid line, an example of each segment waveshape taken out of each frame. The segment waveshape to be taken out should preferably possess average or representative characteristics of the waveshape within the frame.

Figure 6C:
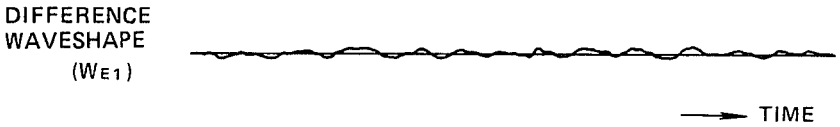

Nextly, the segment waveshape of each frame is coded and a waveshape which repeats within its frame is formed (see the waveshape shown by a dotted line in FIG. 6*b*). The repeated waveshapes of the respective coded segment waveshapes connected in time sequence are equivalent to the basic tone signal $W_S$. Difference ($W_O$–$W_S$) between the basic tone signal produced in this manner and the original waveshape is computed over the complete sounding period and a difference waveshape $W_{E1}$ as shown in FIG. 6*c* thereby is obtained. This waveshape is equivalent to the above described first difference waveshape. A first difference signal $W_{ES1}$ is produced by coding this waveshape and this difference signal is stored in the difference memory 20' in the same manner as was previously described. The second, third, . . . , n-th difference signals may also be produced in the previously described manner. On the other hand, the segment waveshape of each frame taken out and coded as described above is stored in the segment waveshape memory 40. In the memory 40, a set of segment waveshapes thus obtained is stored for each tone color which is selectable in the tone color selection circuit 15 and one set of segment waveshapes is designated by the tone color selection information TC. The same is the case with the difference memory 20'.

For taking a segment waveshape out of the original waveshape, waveshapes of plural periods within each frame may be arithmetically averaged and a resulting average value may be selected as the segment waveshape instead of taking out the entire waveshape within the frame. For selecting frames, i.e., dividing the original waveshape into frames, the original waveshape should preferably be divided into frames by a group of waveshapes having relatively high correlation among one another (i.e., resembling one another). The segment waveshape to be stored in the memory 40 is not limited to a waveshape of one period but it may be a waveshape of plural periods (e.g., 2 periods) or of a half period or of a quarter period. If a segment waveshape of plural periods is stored, waveshapes of a portion having relatively high correlation within the frame are preferably selected as the segment waveshape so that the difference signal will become small. If the segment waveshape of a half period is stored, the polarity of the segment waveshape read out from the memory 40 should be controlled alternately between the positive polarity and the negative one each time the segment waveshape is read out.

In FIG. 5, an address counter 41 generates an address signal for reading out a segment waveshape for one period repeatedly from the memory 40. A frame counter 42 generates a frame address signal FA which designates the frame whose segment waveshape should be read out from the memory 40. More specifically, the segment waveshape memory 40 repeatedly produces, in response to the address signal form the address counter 41, one segment waveshape corresponding to the frame order designated by the frame address signal FA from the frame counter 42 from among the set of segment waveshapes designated by the tone color selection information TC.

A variable frequency-dividing circuit 18' generates a note clock pulse of a frequency corresponding to the tone pitch determined by the key code KC supplied from the key assigner 13 and supplies this note clock pulse to a count input terminal C of the address counter 41. The address counter 41 has a modulo number corresponding to the number of sample points existing in one period of the segment waveshape so that its counting contents successively increase in response to the note clock pulse thereby causing sequential sample point amplitude data of the segment waveshape to be read out from the memory 40. Each time the address counter 41 counts a predetermined modulo number, a carryout signal is produced which in turn is applied to a count input terminal C of a repeating time counter 43. To reset inputs R of the address counter 41 and the repeating time counter 43 is applied the key-on pulse KONP provided by the key assigner 13. Each time one period of segment waveshape has been read out from the memory 40, the carryout signal is generated from the address counter 41. Accordingly, the number of times the segment waveshape has been repeatedly read out, i.e., the frequency, is counted by the repeating number counter 43.

A repeating number memory 44 prestores data of the repeating number in accordance with various tone colors and the frame number of the segment waveshape and produces a predetermined repeating number in response to the tone color selection information TC and the frame address signal FA from the frame counter 42. The repeating number data read out from the memory 44 and the count output of the repeating time counter 43 are compared with each other in a comparator 45 and, when both coincide with each other, a signal "1" is produced from a coincidence output terminal EQ of the comparator 45. This signal is applied to a count input terminal C of the frame counter 42 through a gate 46. The frame counter 42 is reset at the beginning of the key depression by the key-on pulse KONP and at first designates a segment waveshape of the frame number 0, i.e., one concerning the first frame. Subsequently, the frame counter 42 is counted up and the frame address is sequentially switched each time the comparator 45 has detected coincidence.

An end detection circuit 47 detects that the count of the counter 42, i.e., the frame address signal FA, has reached a predetermined final value and, responsive to this detection, disables the gate 46. Therefore, the counting operation of the frame counter 42 is stopped when the reading has proceeded to the predetermined final frame and thereafter the segment waveshape corresponding to the final frame is repeatedly read out.

By virtue of the above described construction, one segment waveshape is repeatedly read out from the segment waveshape memory 40 in response to the address counter 41 and the segment waveshape to be read out is successively switched in time sequence in response to the output of the frame counter 42 with a result that a basic tone signal whose waveshape changes with time (such as one shown in FIG. 6*b*) is read out from the memory 40. This basic tone signal is applied to the adder 25 where it is added and synthesized with the difference signal supplied from a difference signal generation channel 11A. In the difference signal generation channel 11A, as in the one shown in FIG. 2, data of the difference signal is stored in the memory 20' by the ADM system. A variable frequency-dividing circuit, however, is different from the circuit 20 in FIG. 2 in that it produces a clock pulse of a frequency corresponding to the designated tone pitch by frequency-dividing the master clock pulse $\phi_0$ in accordance with the key code KC. This arrangement is made for utilizing the data stored in the difference memory 20' commonly for each key.

The plural difference signal generation channels as shown in FIG. 4 may be provided also in a case where the basic tone signal generation channel 10A as shown in FIG. 5 is employed.

In the foregoing description, the segment waveshape memory 40 is described as storing data in the PCM system. The data may, however, be stored also by the ADM, DPCM, DM, ADCM or ADPCM system as desired.

In the embodiment of FIG. 5, data stored in the segment waveshape memory 40 and the difference memory 20' is utilized commonly for each key. Alternatively, different data may be stored for each octave as in FIG. 2, or for each group of plural keys or even for each key. The reading of the memories 40 and 20' is not limited to the combination of the variable frequency-dividing circuit and the address counter but other methods including one accumulating the frequency number may be employed. The switching of the segment waveshape to be read out from the memory 40 may be effected upon lapse of a predetermined length of time instead of counting the repeating times.

In the embodiment of FIG. 5, the same segment waveshape is simply repeatedly read out within one frame. Alternatively, a portion between two segment waveshapes of adjacent frames may be interpolated so that the basic tone signal will change smoothly at the time of switching of the segment waveshape.

Figure 7:
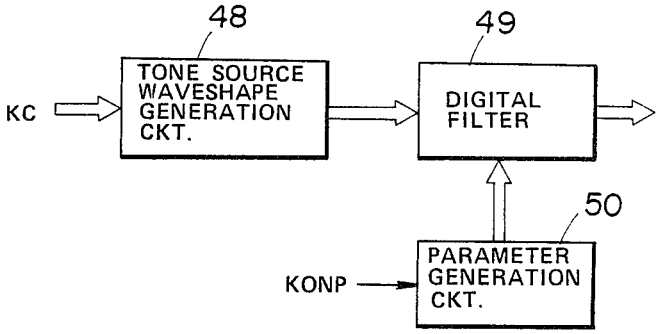
FIG. 7 is an electrical block diagram showing another example of a basic tone signal generation system.

The basic tone signal generation channels 10 and 10A can be composed by utilizing the parameter synthesis system instead of the memory readout system as shown in FIGS. 2 and 5. An example of the parameter synthesis system is shown in FIG. 7. A digital tone source waveshape signal is generated by a tone source waveshape generation circuit 48 in response to the key code KC and this signal is applied to a digital filter 49. The digital filter 49 is controlled in its filter characteristics in accordance with a parameter provided by a parameter generation circuit 50 to produce a basic tone signal whose waveshape changes with time. The parameter generation circuit 50 generates a parameter as is obtained by the prior procedure shown in FIG. 1 in accordance with lapse of time after generation of the key-on pulse KONP.

As described in the foregoing, according to the invention, the basic tone signal generation means and the difference signal generation means can be provided with a relatively small memory capacity and with a relatively simplified circuit construction and, accordingly, a tone signal of a high quality whose tone color (waveshape) changes with time can be generated with a relatively simple circuit construction.

I claim:

1. A tone signal generation device comprising:

pitch designation means for designating a pitch of a tone to be generated;

basic tone signal generation means for generating a basic tone signal having said designated pitch, said tone signal being derived from a waveshape resembling all or a certain portion of the waveshape of the tone to be generated from the start of sounding of the tone to the end thereof, and having plural periods and a tone color which changes in accordance with a lapse of time;

difference signal generation means for generating a difference signal corresponding to a difference between said all or certain portion of the waveshape of the tone to be generated and said basic tone waveshape and having an amplitude which is substantially smaller than the amplitude of said basic tone signal said difference signal having plural periods and a tone color which changes in accordance with a lapse of time; and synthesizing means connected to said basic tone signal generation means and said difference signal generation means for synthesizing a tone signal corresponding to the desired tone signal on the basis of said basic tone signal and said difference signal.

2. A tone signal generation device as defined in claim 1 wherein said basic tone signal generation means comprises:

a basic tone memory for storing said basic tone signal whose waveshape has plural periods; and readout means for reading out said basic tone signal in accordance with said designated pitch.

3. A tone signal generation device as defined in claim 1 wherein said difference signal generation means comprises:

a difference memory for storing said difference signal; and readout means for reading out said difference signal in accordance with said designated pitch.

4. A tone signal generation device as defined in claim 1 wherein said basic tone signal is constituted by basic tone data, said basic tone data being data which said desired tone signal is coded over a complete sounding period of said desired tone signal.

5. A tone signal generation device as defined in claim 1 wherein said basic tone signal generation means comprises:

waveshape memory means for storing frame data relating to a plurality of frame waveshapes respectively belonging to a plurality of frames into which said basic tone signal is divided; and readout means for reading out said frame data from said waveshape memory means at a rate corresponding to said designated pitch successively, said basic tone signal being constituted by said frame data.

6. A tone signal generation device as defined in claim 1 wherein said basic tone signal generation means comprises:

parameter generating means for generating a parameter for synthesizing said basic tone signal; and synthesizing means for synthesizing said basic tone signal in accordance with said parameter and said designated pitch.

7. A tone signal generation device as defined in claim 1 wherein said difference signal generation means includes a memory having first to n-th memory areas storing first to n-th difference signal data respectively, said first difference signal data being a coded waveshape of a first difference waveshape which represents a difference between said desired tone signal and said basic tone signal and said n-th difference signal data being a coded waveshape of an n-th difference waveshape which represents a difference between an $(n-1)$th difference signal to be stored in the $(n-1)$th memory area and $(n-1)$th difference signal data which has actually been stored in said $(n-1)$th memory area, said difference signal being constituted by said first to n-th difference signal data.

8. A tone signal generation device as defined in claim 1 which further comprises tone color designation means for designating a tone color from among a plurality of tone colors, and wherein said basic tone signal generation means and difference signal generation means generate said basic tone signal and said difference signal corresponding to the designated tone color respectively.

9. A tone signal generation device as defined in claim 1 wherein said basic tone signal generation means comprises:

first means for generating basic tone data which are represented in such a form that said basic tone signal is modulated in accordance with a predetermined modulation manner; and second means for demodulating said basic tone data generated by said first means to produce said basic tone signal.

10. A tone signal generation device as defined in claim 1 wherein said basic tone signal generation means comprises:

tone source waveshape generation means for generating a tone source waveshape signal in accordance with said designated pitch;

filter coefficient generation means for generating a filter coefficient; and digital filter means connected to said tone source waveshape generation means and said filter coefficient generation means for digital-filtering said tone source waveshape signal in accordance with a filter characteristic determined by said filter coefficient to produce said basic tone signal.

11. A tone signal generation device as defined in claim 1 wherein said basic tone signal is a signal produced by sampling an original tone waveshape corresponding to said desired tone signal with a predetermined sampling rate and coding amplitude values of respective sample points with a digital value of N bits; and said difference signal is a signal produced by coding a differenre between said coded basic tone signal and said original tone waveshape with a digital value of M bit or bits, wherein M and N are positive integers and M is greater than N.

12. A tone waveshape data providing method comprising:

a step for coding all or a certain portion of an original waveshape representing a tone from the start of sounding of the tone to the end thereof to make first waveshape data, said all or certain portion of the original waveshape having plural periods and a tone color which varies with time;

a step for substracting said first waveshape data from said all or certain portion of the original waveshape to make second waveshape data, said second waveshape data having plural periods and a tone color which varies with time; and a step for storing said first and second waveshape data in a memory device, a combination of said first and second waveshape data being utilized as tone waveshape data.

13. Tone waveshape data providing method as defined in claim 12 which further comprises:

a step for reading out said first and second waveshape data from said memory device; and a step for providing a musical tone signal based on the read out first and second waveshape data.

* * * * *